United States Patent [19]

Freeman et al.

[11] Patent Number: 4,889,508

[45] Date of Patent: Dec. 26, 1989

[54] BOW FACING ROWING SYSTEM

[76] Inventors: George V. Freeman, 115 Linden St., South Hamilton, Mass. 01982; Roland T. Freeman, 344 Lake Dr., Hamilton, Mass. 01936

[21] Appl. No.: 247,418

[22] Filed: Sep. 21, 1988

[51] Int. Cl.[4] ..... B63H 16/10

[52] U.S. Cl. ..... 440/103; 440/102

[58] Field of Search ..... 440/102, 103

[56] References Cited

U.S. PATENT DOCUMENTS

| | | | |
|---|---|---|---|
| 706,491 | 8/1902 | Hanson | 440/103 |
| 2,415,432 | 2/1947 | Krueger | 440/103 |
| 2,668,965 | 2/1954 | Mallenhauer | 440/102 |
| 4,738,643 | 4/1988 | Noggle | 440/103 |

*Primary Examiner*—Sherman D. Basinger
*Assistant Examiner*—Thomas J. Brahan
*Attorney, Agent, or Firm*—Edward A. Gordon

[57] ABSTRACT

A bow facing rowing system comprising the combination of an oar reversing device and a bracket device for supporting the oar reversing device. The oar reversing device includes a housing having opposing ends which terminate in a pair of upper and lower flanges defining fixed spaces therebetween. A train of gears is disposed essentially within the housing with one end gear of the train of gears forming a first terminal gear having an integral extension passing through the adjacent fixed space and terminating in an oar member and the opposite end gear of the train of gears forming a second terminal gear having an integral extension passing through the adjacent fixed space and terminating in a handle member. The gears intermesh in the same plane to thereby transmit motion in reverse from the handle member to the oar member. The bracket device for supporting the oar reversing device includes at least one mounting base plate, a pair of spaced side bearing plates attached to the base plate and a base bearing plate disposed between and attached to the side bearing plates which forms a receptacle to receive the housing member. The base surface of the housing member and the surface of the base bearing plare are configured so as to create a fulcrum point therebetween whereby vertical motion applied to the handle member is transmitted to the oar member.

9 Claims, 2 Drawing Sheets

BOW FACING ROWING SYSTEM

BACKGROUND OF THE INVENTION

1. Field of the Invention

The present invention relates to boats and oars therefor and more particularly to a new and improved rowing device which enables the oarsman to row while facing the direction of the travel or course to be taken.

2. Description of The Prior Art

Various oar reversing are known. The state of the art is exemplified in the following U.S. Patents:

U.S. Pat. No. 727,731 discloses a bow facing oar in which the handle and blade of the oar both have gears fixed to their mating ends and pivot pins through the center of the gears. U.S. Pat. Nos. 1,552,966 and 3,884,175 each illustrate a similar type of oar reversing device.

U.S. Pat. No. 1,107,117 discloses bevel gears whereby the gears attached to the handle and oar can be stacked one above the other.

U.S. Pat. No. 982,202 discloses a three gear oak reversing device.

Each of the foregoing patents disclose various complicated bracket arrangements for supporting the oar reversing devices on the sides of the boats.

While such prior art devices provide improvement in the areas intended, there still exists a great need to provide a new and improved bow facing rowing system of a character which is simple in construction, durable in use, efficient in operation and economical in manufacture.

Accordingly, a principal desirable object of the present invention is to provide a new and improved rowing device having the foregoing characteristics.

Another desirable object of the present invention is to provide a bow facing rowing system including a novel oar lock assembly.

A still further desirable object of the present invention is to provide a safer oar reversing system.

A still further desirable object of the present invention, in a preferred embodiment, is to provide a linear train of gears essentially enclosed which provide greater strength and smoother action.

These and other desirable objects of the invention will in part appear hereinafter and will in part become apparent after consideration of the specification with reference to the accompanying drawings and the claims.

SUMMARY OF THE INVENTION

The present invention provides a bow facing rowing system comprising the combination of an oar reversing device and a bracket device for supporting the oar reversing device. The oar reversing device includes a housing having opposing ends which terminate in a pair of upper and lower flanges defining fixed spaces therebetween and a rounded base surface. A train of gears is disposed essentially within the housing with one end gear of the train of gears forming a first terminal gear having an integral extension passing through the adjacent fixed space and terminating in means to releasably receive an oar member and the opposite end gear of the train of gears forming a second terminal gear having an integral extension passing through the adjacent fixed space and terminating in means to releasably receive a handle member. The gears intermesh in the same plane to thereby transmit motion in reverse from the handle member to the oar member. The invention further contemplates a bracket device for supporting the oar reversing device including at least one base plate adapted to be mounted, for example, on the gunwale of a boat. A pair of spaced side bearing plates are attached to the base plate and positioned in vertical parallel alignment relative to each other above the base plate. The bracket device further includes a base bearing plate disposed between and attached to the side bearing plates which forms a receptacle to receive the housing member so that the rounded base surface of the housing member contacts the base bearing plate creating a fulcrum point whereby vertical motion applied to the handle member is transmitted to the oar member.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
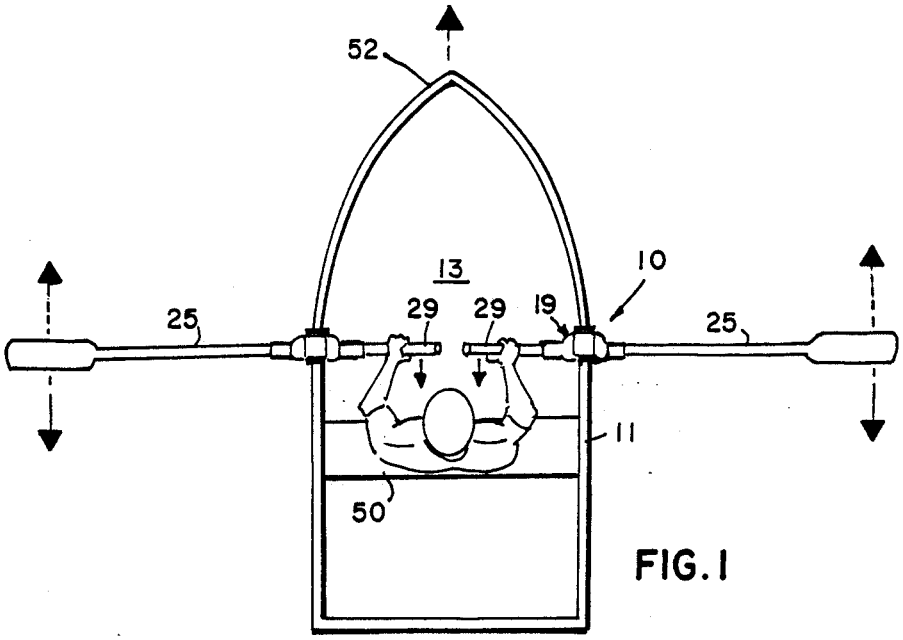
FIG. 1 is a top plan view of a boat provided with a pair, as commonly used, of the rowing systems in accordance with the present invention.

Referring now to the drawings in greater detail, in FIG. 1 a pair of bow facing rowing systems in accordance with the present invention are generally indicated by the numeral 10 and shown attached to the gunwales or sides 11 of boat 13.

Figure 3:
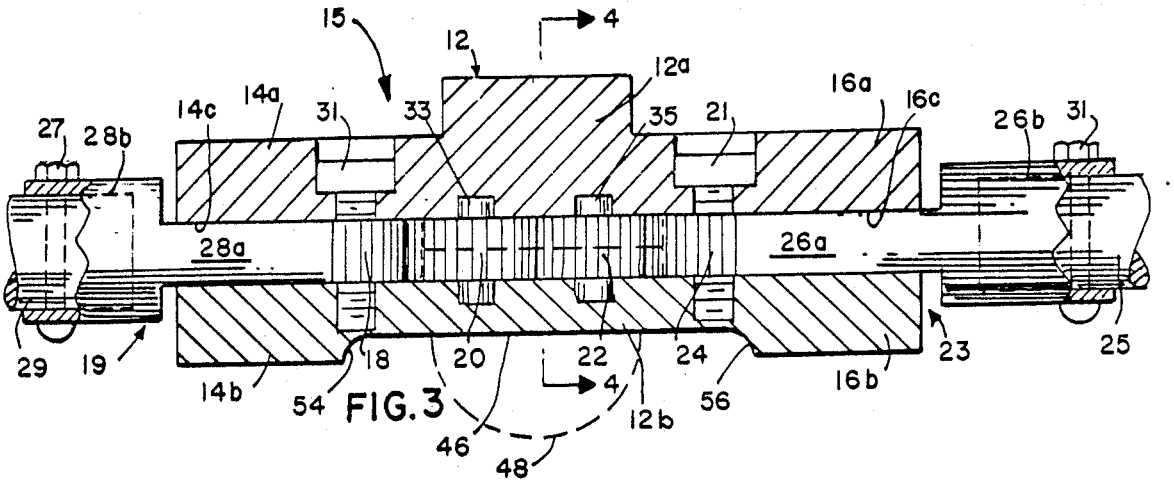
FIG. 3 is a cross sectional view taken along the line 3—3 of FIG. 2.
Figure 5:
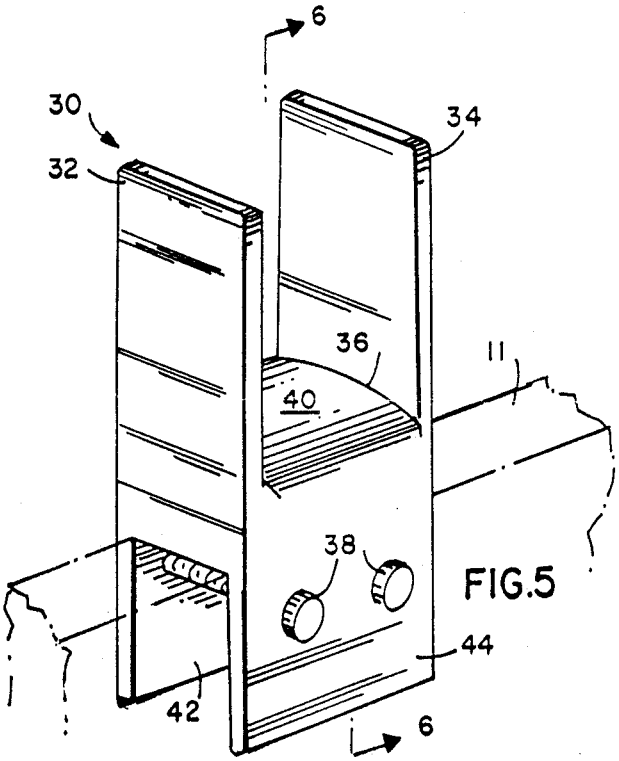
FIG. 5 is a perspective view illustrating a preferred embodiment of the bracket device of the present invention as attached to the side of a boat.

The bow facing rowing system of the present invention comprises the combination of an oar reversing device generally indicated as 15 (as best seen in FIG. 3) and a bracket device generally indicated as 30 (as best seen in FIG. 5).

The oar reversing device 15 includes a housing 12 having an upper member **12*a* and a lower member 12*b*. The upper housing member 12*a* terminates in a pair of flange members 14*a* and 16*a*. Similarly, the lower housing member 12*b* terminates in a pair of corresponding flanges 14*b* and 16*b*. The pairs of upper and lower flanges 14*a*, 14*b* and 16*a* and 16*b* each defined fixed space 14*c* and 16*c*** therebetween as discussed hereinafter.

A train of gears 18, 20, 22 and 24 are essentially enclosed within the housing 12 of the oar reversing device. The end gear 18 forms a first terminal gear having an integral extension designated generally by the numeral 19. The gear extension 19 has an inner reduced portion **28*a* which passes through space 14*c* and an outer portion shown as a sleeve means 28b for receiving a handle member 29 which is releasably secured by suitable means such as bolt 27. The gear 18 and its integral extension 19 are pivotally mounted on bolt 31. Similarly the end gear 24 forms a second terminal gear having an integral extension designated generally by the numeral 23. The gear extension 23 has an inner reduced portion 26a which passes through space 16c and an outer portion shown as a sleeve means 26b for receiving an oar member 25 which is releasably secured by suitable means such as bolt 31. The gear 24 and its integral extension 23 are pivotally mounted on bolt 21. Gears 20 and 22 are rotatably mounted on bolts 33 and 35** respectively.

The gears 18, 20, 22 and 24 are arranged to intermesh in the same place and thereby transmit motion in reverse from the handle member 29, which serves as the driving shaft, to the oar member 25.

Figure 4:
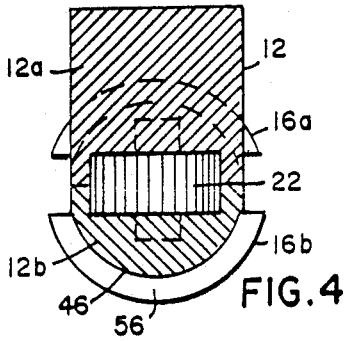
FIG. 4 is a cross sectional view taken substantially along the line 4—4 of FIG. 3.
Figure 6:
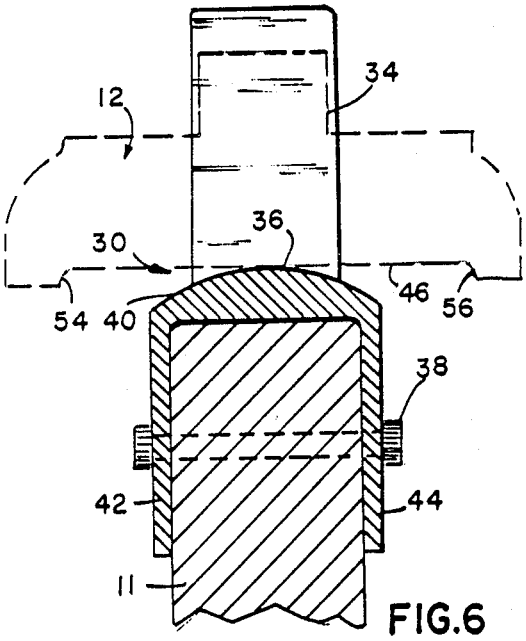
FIG. 6 is a cross sectional view taken substantially along the line 6—6 of FIG. 5 and illustrating by dotted line a fragmentary portion of the oar reversing device (as shown in FIG. 3) as positioned on the bracket device.

Referring now more particularly to FIGS. 4–6, the invention further contemplates a bracket device indicated generally by the numeral 30 for supporting the oar reversing device 15. The bracket device 30 includes a pair of spaced upper side bearing plates 32 and 34 positioned in vertical parallel alignment relative to each other above the base bearing plate 36 which is provided with a convex or curved surface 40 as discussed further hereinafter. The bracket 30 further includes a lower U-shaped portion formed of a pair of base supporting plates 42 and 44 which serve to attach the bracket 30 to the gunwale 11 and are held in position by bolts 38. While a pair of base plates is preferred, it is to be understood that a single plate can be used for the attachment.

In the preferred embodiment of the invention the housing 12 is provided with a rounded base surface portion 46 as best seen in FIG. 4. When the oar reversing device 15 is positioned within the bracket support 30, the curvature of the base surface 46 is at a 90° angle to the curvature of the surface 40 of base bearing plate 36 as shown in FIG. 6. In this manner the common contact area of both surfaces form a fulcrum point whereby vertical motion applied to the handle member of the rowing system 10 is easily transmitted to the oar member. It can be appreciated that the invention also contemplates an arrangement whereby one surface, for example, the surface 40 of base bearing plate is flat (not shown) and the housing 12 is provided with a convex surface which is curved in a longitudinal direction, that is, from the handle member to the oar member as shown by the dotted line 48 of FIG. 3. Similarly the fulcrum arrangement can be obtained by providing a flat surface (not shown) at the portion 46 for contact with the convex surface 40 of the bracket 30.

Figure 2:
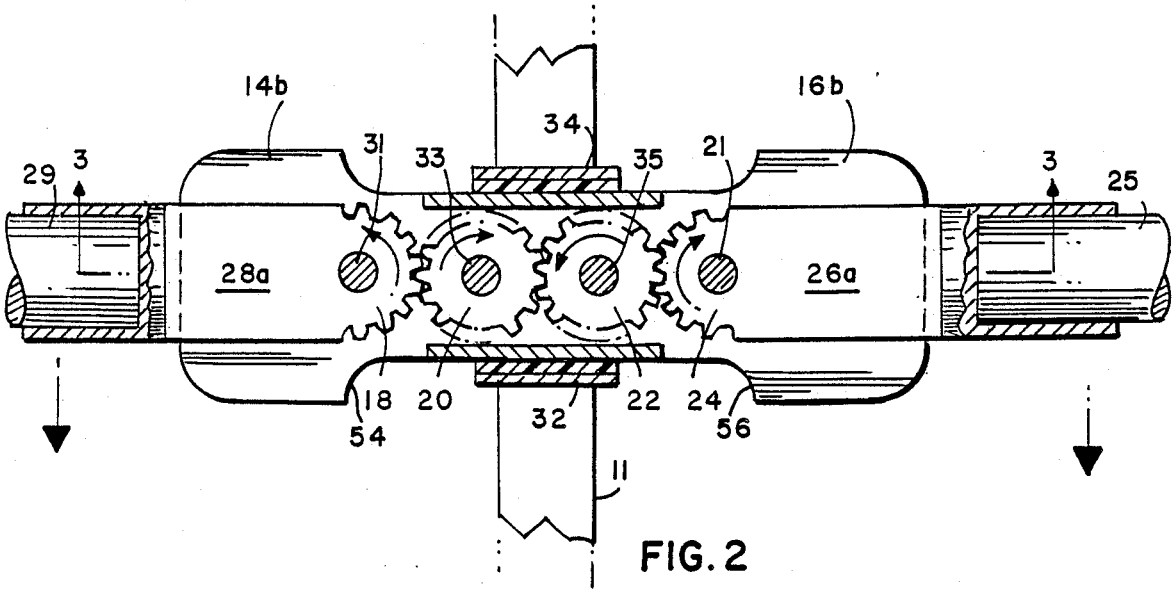
FIG. 2 is a top plan view, partly in section and partly broken away of the embodiment of FIG. 1.

In propelling a boat with the rowing system of the present invention, the operator or rower, referring now more particularly to FIG. 1, sits on the seat 50 and faces forward toward the bow 52. The handles 29 are grasped and either alternately or synchronously pushed and pulled. When the handles are being pushed as shown by the dotted arrows, the oars are simultaneously moved forward. At the same time the handles are being pushed forward, they are also pressed downward so as to pivot the system and raise the oars above the surface of the water. When the handles are pulled back they are simultaneously raised to tilt the oars into the water and the oars are also moved backward as shown by the solid arrows. In this manner the boat is propelled forward in the direction in which the operator is facing. In connection with the tilting or pivoting of the oar reversing device about it's fulcrum, the housing 12 is preferably provided with opposing projecting rim portions 54 and 56 (as best seen in FIGS. 2, 3, 4 and 6) which are disposed about the sides as well as the bottom portion of the housing to limit the lateral movement of the housing 12 within the bracket 30. As best seen in FIG. 2, the rims 54 and 56 can be formed as part of the inner ends of the flanges 14a, 14b and 16a, 16b.

The bow facing rowing system of the present invention provides numerous advantages including (a) an oar reversing device which can be quickly and easily installed without the necessity of removing bolts, pins and the like; (b) a bow facing rowing system which is constructed and arranged so that the operator rows in the conventional manner; (c) provides a gear train arrangement which more adequately distributes oaring forces over the gunwale; (d) provides greater strength and smoother action with minimization of flexing or play in the oar; and (e) provides an oar reversing device in which the first and second terminal gears and their intergral extensions are mirror images of each other and is therefore versatile and rotatable with respect to its position when inserted in a bracket support.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A bow facing rowing system comprising the solution of an oar reversing device and a bracket device for supporting said oar reversing device;

said oar reversing device including:

a housing having opposing ends which terminate in a pair of upper and lower flanges defining fixed spaces therebetween;

said housing member having a rounded base surface;

a train of gears disposed essentially within said housing;

one end gear of the train of gears forming a first terminal gear having an integral extension passing through the adjacent fixed space and terminating in means to releasably receive an oar member;

the opposite end gear of the train of gears forming a second terminal gear having an integral extension passing through an adjacent fixed space and terminating in means to releasably receive a handle member;

said gears intermeshing in the same plane to thereby transmit motion in reverse from said handle member to said oar member; and a bracket device for supporting said oar reversing device including:

at least one base flange member adapted to be mounted on a boat;

a pair of spaced side bearing plates attached to said base plate and positioned in vertical aligment relative to each other above said base flange member; and a convex base bearing plate disposed between and attached to said side bearing plates;

said side and convex base bearing plates forming a receptacle to receive said housing member so that the rounded base surface of said housing member contacts said convex base bearing plate creating a fulcrum point whereby vertical motion applied to said handle member is transmitted to said oar member.

2. A bow facing rowing system comprising the combination of an oar reversing device and a bracket device for supporting said oar reversing device;

said oar reversing device including:

a housing having opposite ends which terminate in a pair of upper and lower flanges defining fixed spaces therebetween;

a train of gears disposed essentially within said housing;

one end gear of the train of gears forming a first terminal gear having an integral extension passing through the adjacent fixed space and terminating in means to releasably receive an oar member;

the opposite end gear of the train of gears forming a second terminal gear having an integral extension passing through the adjacent fixed space and terminating in means to releasably receive a handle member;

said gears intermeshing to thereby transmit motion in reverse from said handle member to said oar member; and a bracket device for supporting said oar reversing device including:

a base support means adapted to be mounted on a boat;

a pair of spaced side bearing plates attached to said base support means and positioned in vertical alignment relative to each other above said base support means; and a base bearing plate disposed between and attached to said side bearing plates;

said side and base bearing plates forming a receptacle to receive said housing member, the base surface of said housing member and said base bearing plate being configured so as to create a fulcrum point therebetween whereby vertical motion applied to said handle member is transmitted to said oar member.

3. The bow facing rowing system of claim 2 wherein said train of gears comprises four gears intermeshed in the same plane to thereby transmit motion in reverse from one integral extension to the other.

4. The bow facing rowing system of claim 2 wherein said base support means comprises a U-shaped support member.

5. The bow facing rowing system of claim 2 wherein said housing member is provided with a convex base surface and said base bearing plate with a flat surface whereby contact therebetween forms a fulcrum point.

6. The bow facing rowing system of claim 2 wherein said first and second terminal gears and the integral extensions thereof are mirror images of each other.

7. The bow facing rowing system of claim 2 wherein the lower surface of said housing member is provided with a pair of opposing lateral flange members whereby lateral movement of the oar reversing device within said bracket device is limited.

8. The bow facing rowing system of claim 2 wherein the portions of the upper and lower flange members adjacent the housing member limit lateral movement of the oar reversing device within the bracket device.

9. A blow facing rowing system comprising the combination of an oar reversing device and a bracket device for supporting said oar reversing device;

said oar reversing device including;

a housing having opposing ends which terminate in a pair of upper and lower flanges defining fixed spaces therebetween;

said housing member having a rounded base surface;

a train of gears disposed essentially within said housing;

one end gear of the train of gears forming a first terminal gear having an integral extension passing through the adjacent fixed space and terminating in means to releasably receive an oar member;

the opposite end gear of the train of gears forming a second terminal gear having an integral extension passing through the adjacent fixed space and terminating in means to releasably receive a handle member;

said gears intermeshing in the same plane to thereby transmit motion in reverse from said handle member to said oar member; and a bracket device for supporting said oar reversing device including:

at least one base flange member adapted to be mounted on a boat;

a pair of spaced side bearing plates attached to said base plate and positioned in vertical alignment relative to each other above said blase flange member; and a base bearing plate disposed between and attached to said side bearing plates;

said side and base bearing plates forming a receptacle to receive said housing member so that the rounded base surface of said housing member contacts said base bearing plate creating a fulcrum point whereby vertical motion applied to said handle member is transmitted to said oar member.

* * * * *